US006439691B1

(12) United States Patent
Lee et al.

(10) Patent No.: US 6,439,691 B1
(45) Date of Patent: Aug. 27, 2002

(54) BUBBLE-JET TYPE INK-JET PRINTHEAD WITH DOUBLE HEATER

(75) Inventors: Chung-jeon Lee, Seoul; Jae-ho Moon, Gyeonggi-do; Oh-hyun Baek, Seoul, all of (KR)

(73) Assignee: Samsung Electronics, Co., Ltd., Suwon (KR)

( * ) Notice: Subject to any disclaimer, the term of this patent is extended or adjusted under 35 U.S.C. 154(b) by 0 days.

(21) Appl. No.: 09/988,701

(22) Filed: Nov. 20, 2001

(30) Foreign Application Priority Data

Mar. 15, 2001 (KR) ..... 01-13452

(51) Int. Cl.[7] ..... B41J 2/14; B41J 2/16; B41J 2/05

(52) U.S. Cl. ..... 347/48; 347/65

(58) Field of Search ..... 347/48, 62, 65

(56) References Cited

U.S. PATENT DOCUMENTS 4,494,128 A * 1/1985 Vaught ..... 347/98
6,102,530 A * 8/2000 Kim et al. ..... 347/65

FOREIGN PATENT DOCUMENTS

JP 404182137 * 6/1992 ..... 347/62

* cited by examiner

*Primary Examiner*—Huan Tran
*Assistant Examiner*—Michael S. Brooke
(74) *Attorney, Agent, or Firm*—Robert E. Bsuhnell, Esq.

(57) ABSTRACT

A novel structure for a bubble-jet type ink-jet printhead is provided. A substrate is covered with a nozzle plate perforated by a predetermined number of nozzle holes a predetermined distance from said nozzle plate. The structure is surrounded by walls, within which form a common ink chamber. Each nozzle hole has, on the substrate underneath, a set of resistive elements. One of the resistive elements encircles an edge of a nozzle hole while another lyes directly underneath the perforation. During operation of the printhead, the encircling elements form a doughnut-shaped bubble forming an imaginary or virtual chamber within the doughnut from the rest of the common chamber. After formation of the doughnut-shaped bubble, the resister underneath the perforation forms a big bubble which causes ink to be ejected through the nozzle hole. The structure that allows for the above is easy to manufacture, and produces high quality print.

20 Claims, 15 Drawing Sheets

BUBBLE-JET TYPE INK-JET PRINTHEAD WITH DOUBLE HEATER

CLAIM OF PRIORITY

This application makes reference to, incorporates the same herein, and claims all benefits accruing under 35 U.S.C. § 119 from my application entitled BUBBLE-JET TYPE INK-JET PRINT HEAD WITH DOUBLE HEATER filed with the Korean Industrial Property Office on Mar. 15, 2001 and there duly assigned Ser. No. 2001-13452.

BACKGROUND OF THE INVENTION

1. Field of the Invention

The present invention relates to an ink-jet printhead, and more particularly, to a bubble-jet type ink-jet printhead having an improved heater for forming bubbles.

2. Description of the Related Art

The ink ejection mechanisms of an ink-jet printer are largely categorized into two types: an electro-thermal transducer type (bubble-jet type) in which a heat source is employed to form a bubble in ink causing ink droplets to be ejected, and an electromechanical transducer type in which a piezoelectric crystal bends to change the volume of ink causing ink droplets to be expelled.

Meanwhile, an ink-jet printhead having this bubble-jet type ink ejector needs to meet the following conditions. First, a simplified manufacturing procedure, low manufacturing cost, and high volume production must be allowed. Second, to produce high quality color images, creation of minute satellite droplets that trail ejected main droplets must be prevented. Third, when ink is ejected from one nozzle or ink refills an ink chamber after ink ejection, cross-talk with adjacent nozzles from which no ink is ejected must be prevented. To this end, a back flow of ink in the opposite direction of a nozzle must be avoided during ink ejection. Fourth, for a high speed print, a cycle beginning with ink ejection and ending with ink refill must be as short as possible. Fifth, a nozzle and an ink channel for introducing ink into the nozzle must not be clogged by particles or solidified ink.

However, the above conditions tend to conflict with one another, and furthermore, the performance of an ink-jet printhead is closely associated with structures of an ink chamber, an ink channel, and a heater, the type of formation and expansion of bubbles, and the relative size of each component.

In efforts to overcome problems related to the above requirements, ink-jet print heads having a variety of structures have been proposed. However, ink-jet printheads having the structures proposed may satisfy some of the aforementioned requirements but do not completely provide an improved ink-jet printing approach. Accordingly, it is highly desirable to have a bubble-jet type ink-jet printhead whose fabrication process is simplified without a decrease in the ejection energy of ink.

SUMMARY OF THE INVENTION

To solve the above problems, it is an object of the present invention to provide a bubble-jet type ink-jet printhead which improves ejection energy and eliminates the need for a separate ink chamber by connecting a plurality of heaters in parallel to form bubbles at predetermined time intervals.

Accordingly, to achieve the above object, the present invention provides a bubble-jet type ink jet printhead having a substrate, a nozzle plate having a plurality of nozzles, the nozzle plate being separated a predetermined distance from the substrate, walls for closing the space between the substrate and the nozzle plate and then forming a common chamber between the substrate and the nozzle plate a plurality of first resistive layers formed on the substrate within the common chamber corresponding to the plurality of nozzles, each of the plurality of first resistive layers being centered around the central axis passing through the center of each nozzle a plurality of second resistive layers disposed within the plurality of first resistive layers, wherein each second resistive layer is connected in parallel to each first resistive layer to thereby form a bubble on a central axis passing through the center of each nozzle a plurality of pairs of electrically conductive layers formed on the substrate, each pair being connected to the first and second resistive layers and extending to the outside of the common chamber; and a plurality of electrode pads which are disposed at the outside of the common chamber on the substrate and electrically connected to the electrically conductive layers.

Preferably, the second resistive layer has resistance greater than the first resistive layer, and the second resistive layer is longer and narrower than the first resistive layer. Preferably, ink feed grooves are formed at two opposite ends of the common chamber on the substrate for supplying ink to the common chamber or an ink feed groove is formed at the center of the substrate for supplying ink to the common chamber.

Preferably, a boundary barrier is provided for dividing the common chamber into a plurality of regions and allowing ink to flow from one region to another by spatially connecting the plurality of regions disposed within the common chamber, wherein the boundary barrier has a height equal to the gap between the substrate and the nozzle plate.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1A:
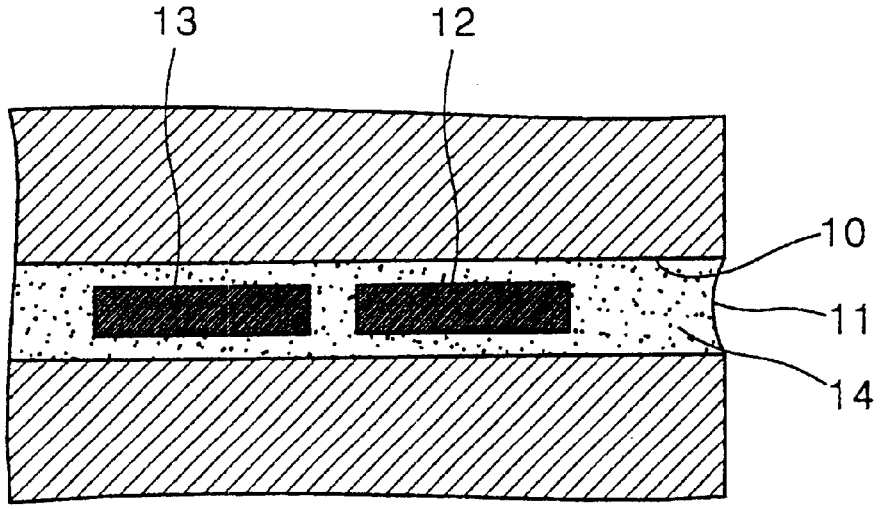
FIGS. 1A and 1B are cross-sections showing the structure of a bubble-jet type ink-jet printhead along with an ink ejection mechanism.
Figure 1B:
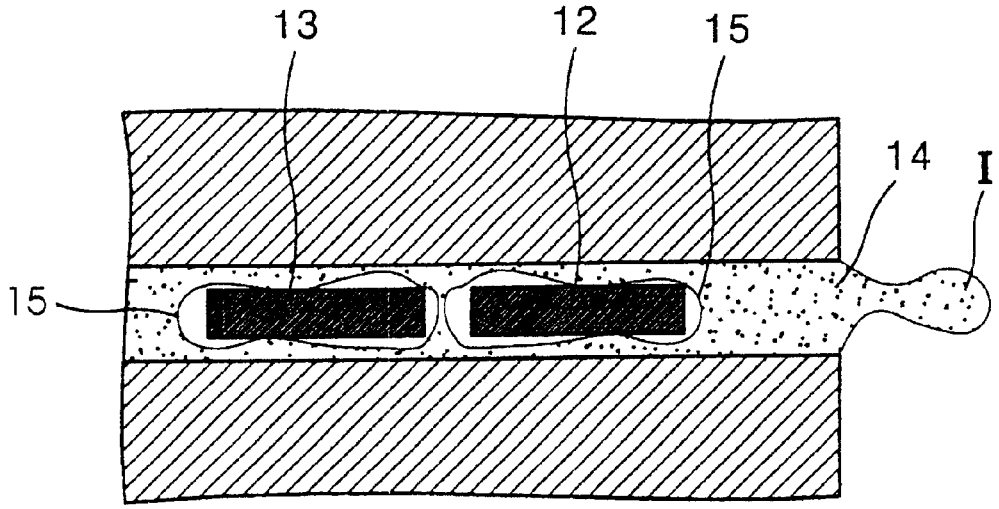

Referring to FIGS. 1A and 1B, a bubble-jet type ink ejection mechanism will now be described. When a current pulse is applied to a first heater 12 consisting of resistive heating elements formed in an ink channel 10 where a nozzle 11 is formed, heat generated by the first heater 12 boils ink 14 to form a bubble 15 within the ink channel 10, which causes an ink droplet I to be ejected.

In FIGS. 1A and 1B, a second heater 13 is provided so as to prevent a back flow of the ink 14. First, the second heater 13 generates heat, which causes a bubble 16 to shut off the ink channel 10 behind the first heater 12. Then, the first heater 12 generates heat and the bubble 15 expands to cause the ink droplet I to be ejected.

Figure 2:
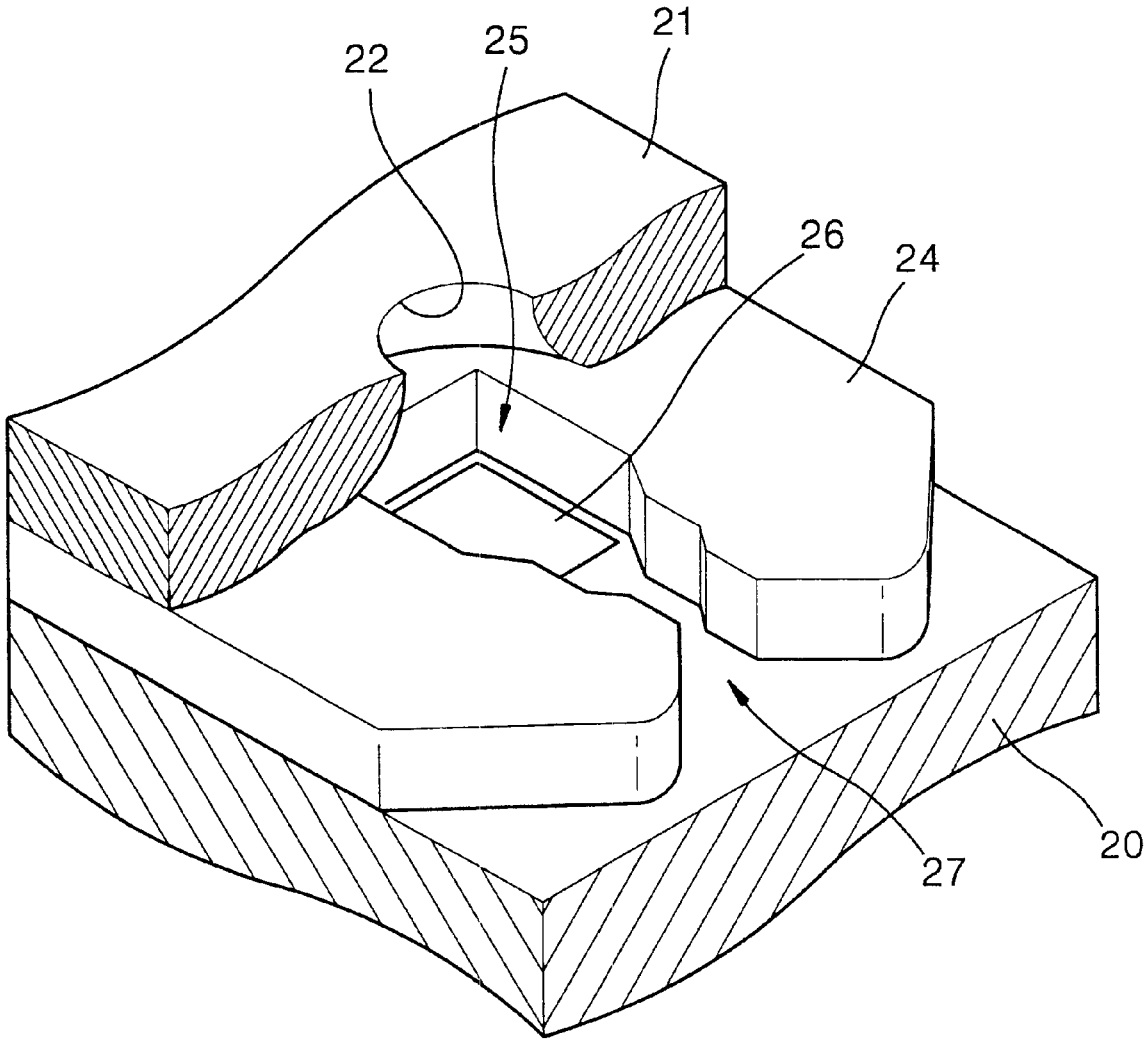
FIG. 2 (PRIOR ART)
FIG. 2 is a partial perspective view of a bubble-jet type ink-jet printhead.

FIG. 2 is a perspective view showing a part of an ink-jet printhead disclosed in U.S. Pat. No. 4,882,595. Referring to FIG. 2, a rectangular heater 26 is formed on a substrate 20. A chamber 25 for providing a space for the heater 26, and an intermediate layer 24 for forming an ink channel 27 for introducing ink into the chamber 25 are provided. A nozzle plate 21 having a nozzle 22 corresponding to the chamber 25 is disposed on the intermediate layer 24. Ink is filled in the chamber 25 through the ink channel 27 and in the nozzle 22 connected to the chamber 25. In the ink-jet printhead having the above structure, since the chamber 25 delimited by the intermediate layer 24 is limited by the ink channel 27 through which ink is supplied only in one direction, ink refills the chamber 25 at low speed. Thus, the ink-jet printhead has the restriction of ejection driving frequency.

Figure 3:
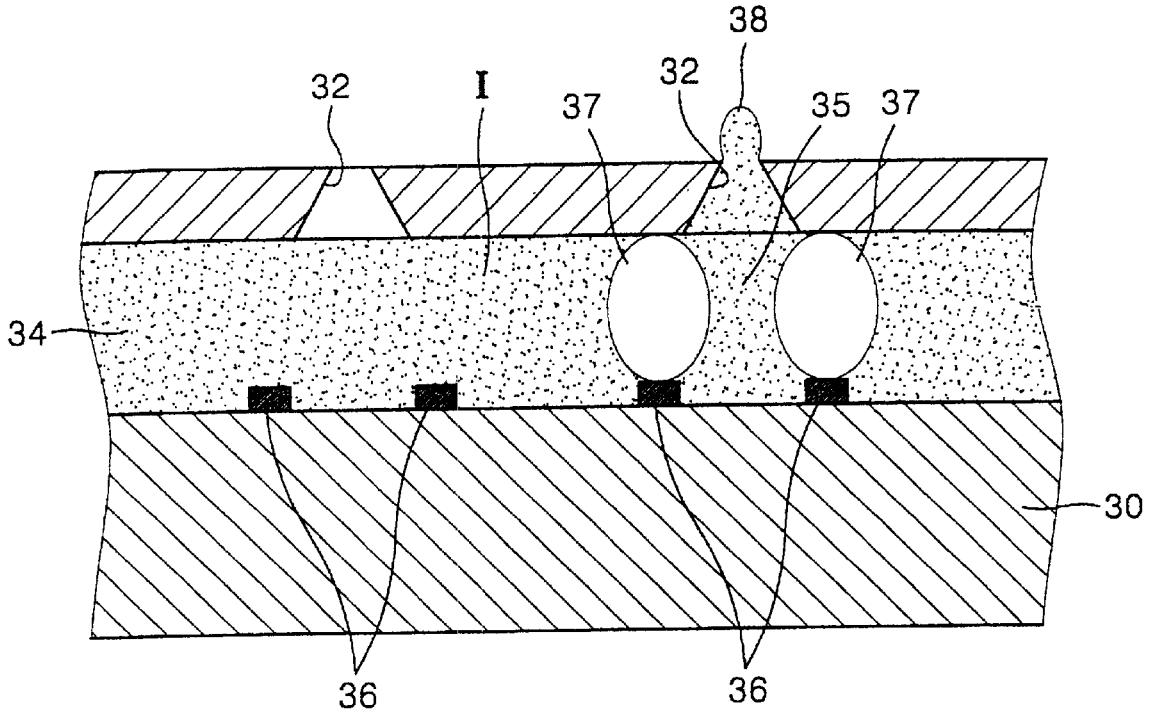
FIG. 3 is a partial cross-section of another bubble-jet type ink-jet printhead.

To overcome the above problem, an ink-jet printhead having a structure shown in FIG. 3 has been proposed. Referring to FIG. 3, a round-shaped heater 36 is formed on a substrate 30, and adjacent nozzles 32 are interconnected by a common chamber 34 instead of an independent chamber as shown in FIG. 2. Thus, if power is applied to the round-shaped heater 36 to generate heat, a plurality of bubbles 37 are formed by the round-shaped heater 36. In this case, the plurality of bubbles 37 form an imaginary (or virtual) ink chamber 35. Ink I is filled in the imaginary ink chamber 35. Then, the plurality of bubbles 37 expand and coalesce to form a larger bubble. The expansion energy of the bubbles 37 causes an ink droplet 38 to be ejected from the nozzle 32.

The ink-jet printhead having the structure as described above can be improved to eliminate the need for a complicated manufacturing process caused by formation of an ink chamber in the ink-jet printhead of FIG. 2 and the reliability of products. However, the ink-jet printhead of FIG. 3 can further be improved as FIG. 3 relies entirely on ink ejection energy caused by the expansion of bubbles 37 formed around the perimeter of the imaginary (or virtual) ink chamber 35 and not on the expansion of a bubble formed within the imaginary ink chamber 35.

Figure 4:
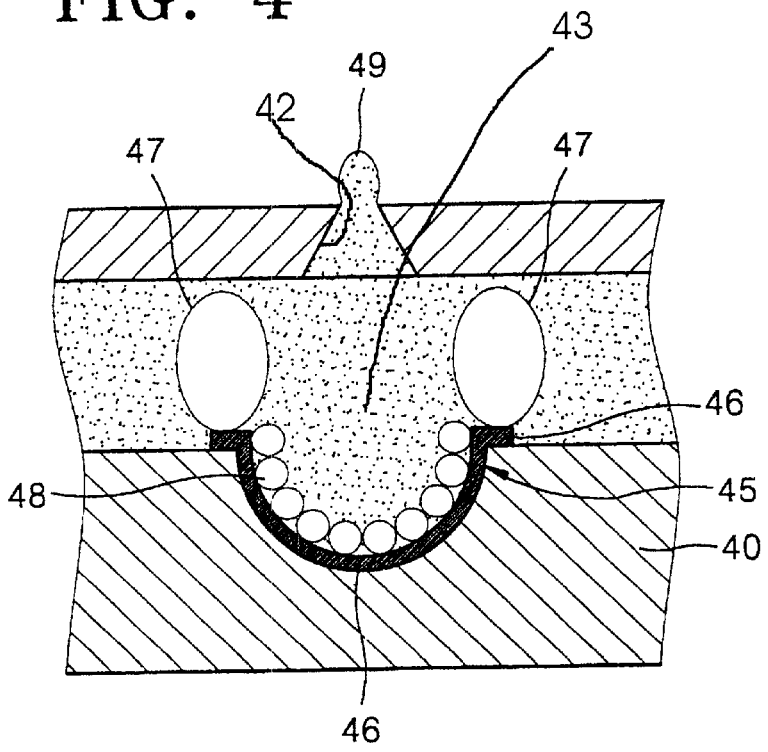
FIG. 4 is a partial cross-section of another bubble-jet type ink-jet printhead.

To solve the above problem, an ink-jet printhead having a structure as shown in FIG. 4 has been proposed. Referring to FIG. 4, a hemispherical shape is formed on a substrate 40, in which a heater 45 having a hemispherical shape is disposed. The heater 45 generates heat to grow bubbles 47 formed on a flange 46 of the heater 45 further to form a barrier and expand bubbles 48 around the hemispherical shape of the heater 45, thereby causing an ink droplet 49 to be ejected from the nozzle 42. Thus, the structure illustrated in FIG. 4 allows for the formation of a virtual (or imaginary) ink chamber 43 caused by doughnut shaped bubble 47 located beneath the periphery of nozzle hole 42, but also on the driving force of bubbles 48 generated by heater 46 located within the virtual ink chamber 43, leading to a more effective ink ejection with high ejection energy and slim possibility of forming satellite droplets after ink droplet 49 is expelled.

The ink-jet printhead having the structure as described above is constructed such that the ink droplet 49 is ejected by the bubbles 48 generated by the hemispherical heater 45, thereby increasing ejection energy compared to the ink-jet printhead of FIG. 3. However, since a hemispherical shape is formed on a substrate, the fabrication process is complicated and thus the manufacturing cost is high. What is needed is a structure that is both simple and inexpensive to manufacture but maintains all the benefits of the structure of FIG. 4: the formation of a virtual chamber by a doughnut shaped bubble and the generation of bubbles within the virtual chamber 43 to further provide a driving force for the ejection of ink droplet 49.

Figure 5:
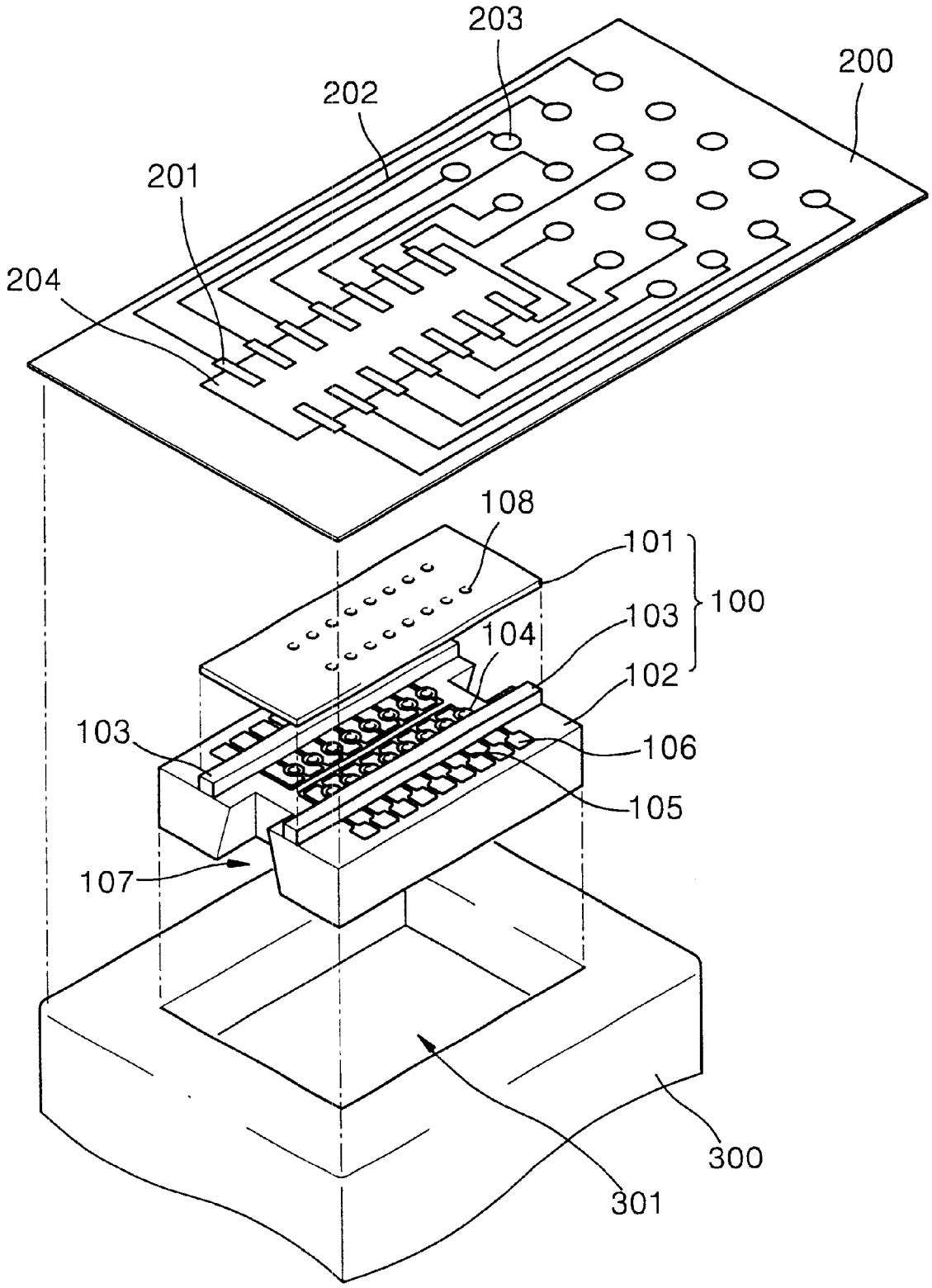
FIG. 5 is an exploded perspective view showing the schematic structure of an ink-jet cartridge, to which a bubble-jet type ink-jet printhead according to a first embodiment of the present invention is applied.

FIG. 5 illustrates an ink-jet printhead according to the present invention. Referring to FIG. 5, a head mount portion 301 is disposed at the upper center of a cartridge 300 for storing ink. A head 100 according to the present invention is inserted into the head mount portion 301. The head 100 includes a substrate 102 and a nozzle plate 101. Walls 103 having a predetermined height are arranged in parallel at regular intervals on the substrate 102, and ink feed grooves 107 are formed at the center portions of both ends of the substrate 102 in the direction in which the walls 103 extend. The wall 103 separates the substrate 102 and the nozzle plate 101 by the predetermined height, between which a common chamber that will be described below is formed. A plurality of resistive layers 104 are disposed at the bottom of the common chamber.

Figure 6:
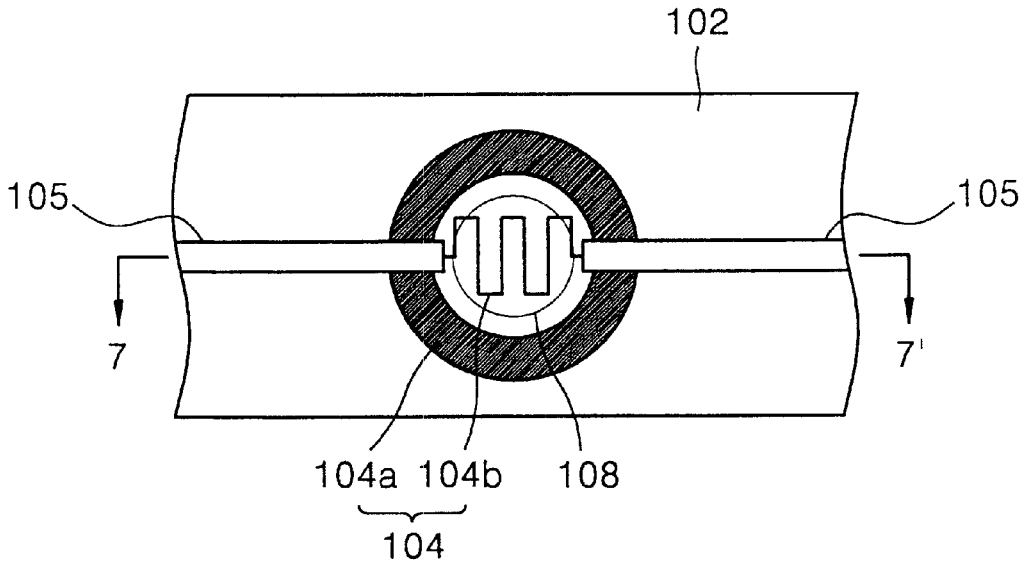
FIG. 6 is a plan view showing the structure of a bubble-jet type ink-jet printhead according to a first embodiment of the present invention.
Figure 7:
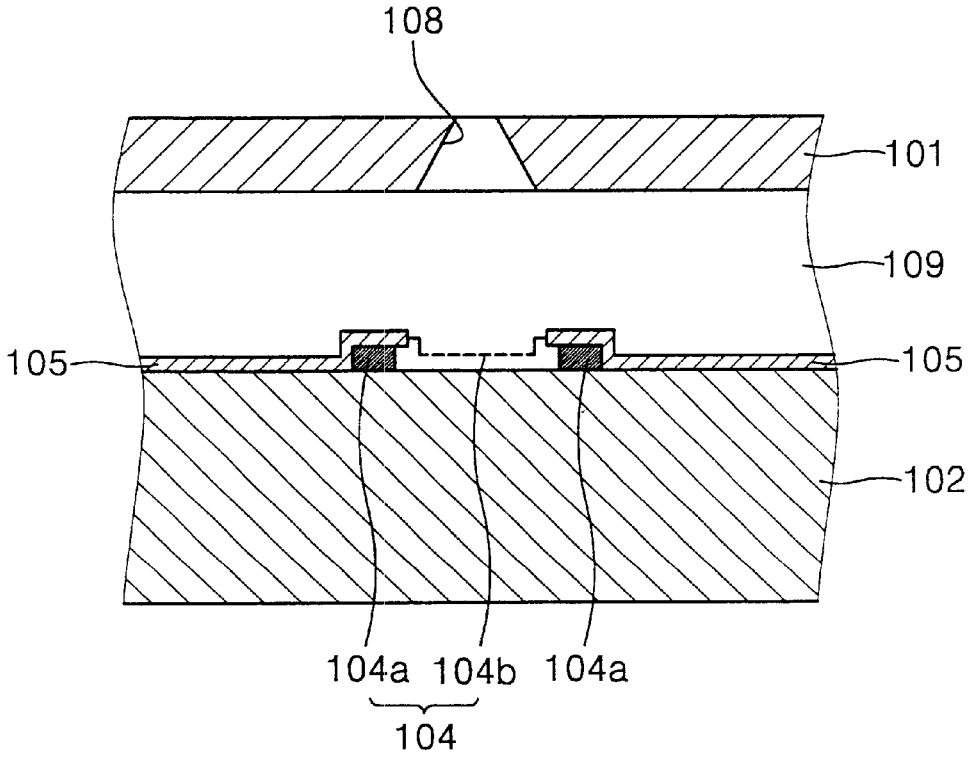
FIG. 7 is a cross-section taken along line 7–7' of FIG. 6.

Referring to FIGS. 6 and 7, each resistive layer 104 includes a first resistive layer **104*a* and a second layer 104*b*. The first resistive layer 104*a* is centered around a central axis passing through the center of each nozzle 108 formed in the nozzle plate 101. The second resistive layer 104*b* is connected in parallel to the inside of the first resistive layer 104*a*. It is preferable that the second resistive layer 104*b* is narrower than the first resistive layer 104*a* and arranged in a long coil type. A plurality of electrically conductive layers 105 are connected to the resistive layers 104, and the electrically conductive layers 105 extend to the outside of both walls 103, where they are coupled to a plurality of pads 106**.

Turning to FIG. 5, each pad 106 on the substrate 102 contacts each terminal 201 disposed on a flexible printed circuit (FPC) board 200. An opening 204 for penetrating the head 100 is also disposed on the FPC board 200. Here, the pads disposed on the substrate 102 correspond one-to-one to the terminals 201 disposed on the FPC board 200. Further, each terminal 201 on the FPC board 200 is connected to a corresponding contact terminal 203 through a wiring line 202. When the cartridge 300 is mounted to a head transport device (not shown) of an ink-jet printer, each contact terminal 203 is in contact with each terminal (not shown) disposed in the head transport device.

Figure 8A:
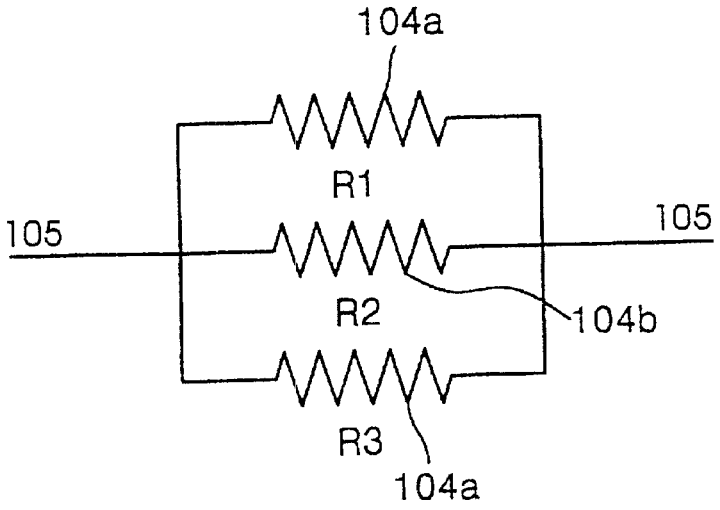
FIG. 8A shows an electrical connection structure of a resistive layer according to a first embodiment of the present invention.

Referring to FIG. 8A, which shows an electrical connection structure of the resistive layer 104 according to a first embodiment of the present invention, resistors R1 and R3 are portions of a circular or closed polygonal first resistive layer 104*a* and a resistor R2 is the second resistive layer 104*b*. Thus, voltages across the resistors R1, R2 and R3 are equal.

The second resistive layer 104*b* is narrower and longer than the first resistive layer 104*a*. Other embodiments include having the second resistive layer made out of a material having a higher resistivity than the first resistive layer. In any case, the resistance in the second resistive layer 104*b* is larger than that in the first resistive layer 104*a*. If a voltage is applied from the outside to the resistive layers 104*a* and 104*b*, the power VI dissipated at the second resistive layer 104*b*, which is the work performed per unit time, is less than the power VI' dissipated at the first resistive layer 104*a*, because P=VI and V=IR, therefore $P=V^2/R$, and the resistance of the second resistive layer 104*b* is greater than the resistance of the first resistive layer 104*a*, as shown in FIG. 8B.

Figure 8B:
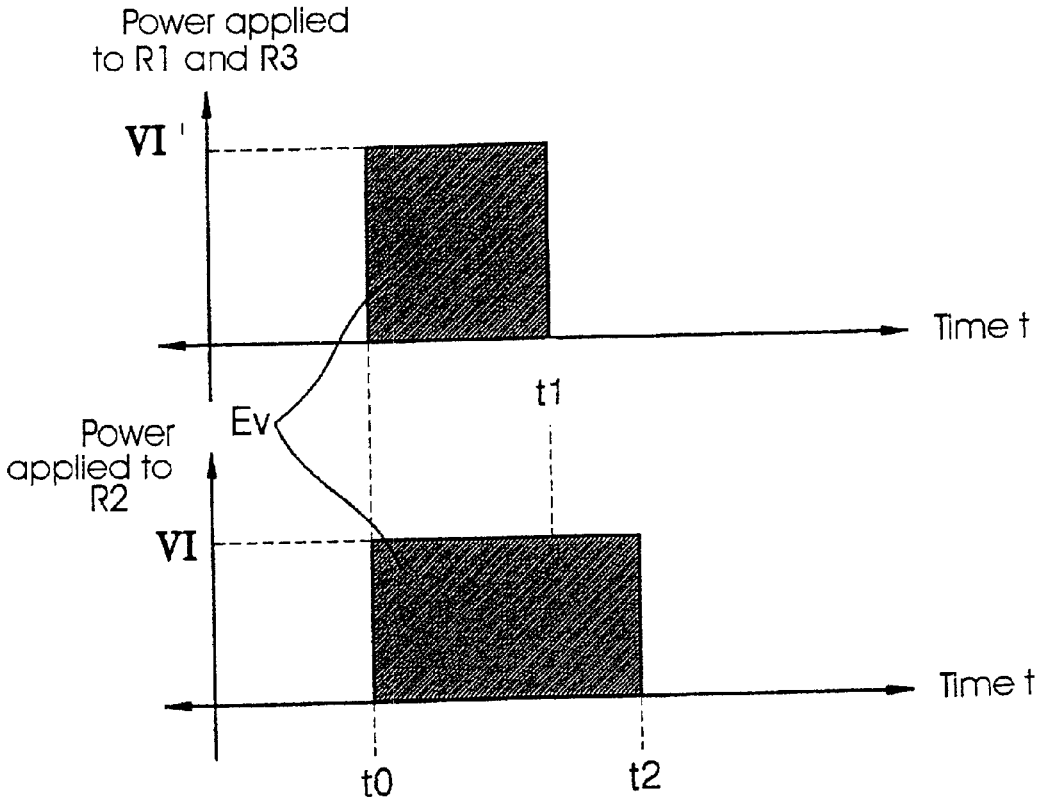
FIG. 8B is a graph of an electric energy on each resistive layer according to a first embodiment of the present invention.

FIG. 8B graphically represents electric energy applied to each resistive layer 104*a* or 104*b* according to a first embodiment of the present invention. Power VI' is delivered to the first resistive layer 104*a* and power VI is delivered to the second resistive layer 104*b*. If electric energy Ev is required for each resistive layer 104*a* or 104*b* to form a big bubble, the time t1 required for the first resistive layer 104*a* to receive Ev is shorter than the time t2 required for the second resistive layer 104*b* to receive Ev, because power VI' dissipated in the first resistive layer is greater than power VI dissipated in the second resistive layer 104*b*, as shown in FIG. 8B. As described above, an important feature of this invention is that the resistances of the first and second resistive layers 104*a* and 104*b* are made to be different from each other. This is intended to make the time at which a big bubble is formed at each resistive layer 104*a* or 104*b* different.

A process of forming bubbles and ejecting an ink droplet in the bubble-jet-type ink-jet printhead according to the first embodiment of the present invention constructed as above will now be described with reference to FIGS. 9A–9D. Firstly, a common chamber 109 is filled with ink 110 in a state in which the first and second resistive layers 104*a* and 104*b* are electrically unloaded (refer to FIG. 9A). Next, bubbles 111 and 112 are formed by the first and second resistive layers 104*a* and 104*b*, respectively, to which a DC pulse is applied. In this case, since the resistance of the first resistive layer 104*a* is less than that of the second resistive layer 104*b*, a larger amount of current flows through the first resistive layer 104*a*. As a result, the bubble 111 formed on the first resistive layer 104*a* is larger than the bubble 112 formed on the second resistive layer 104*b*. If the bubble 111 formed on the first resistive layer 104*a* continues to grow to completely fill the space between the substrate 102 and the nozzle plate 101, the bubble 111 forms an isolated virtual chamber 113 having a doughnut shape within the common chamber 109. Here, since a small size of the bubble 112 is formed on the second resistive layer 104*b* as well, the bubbles 111 and 112 formed on the first and second resistive layers 104*a* and 104*b*, respectively, exert expansion energy on the ink 110 thus pushing a small amount of ink droplet 114 outward the corresponding nozzle 108 (refer to FIG. 9B).

Figure 9A:
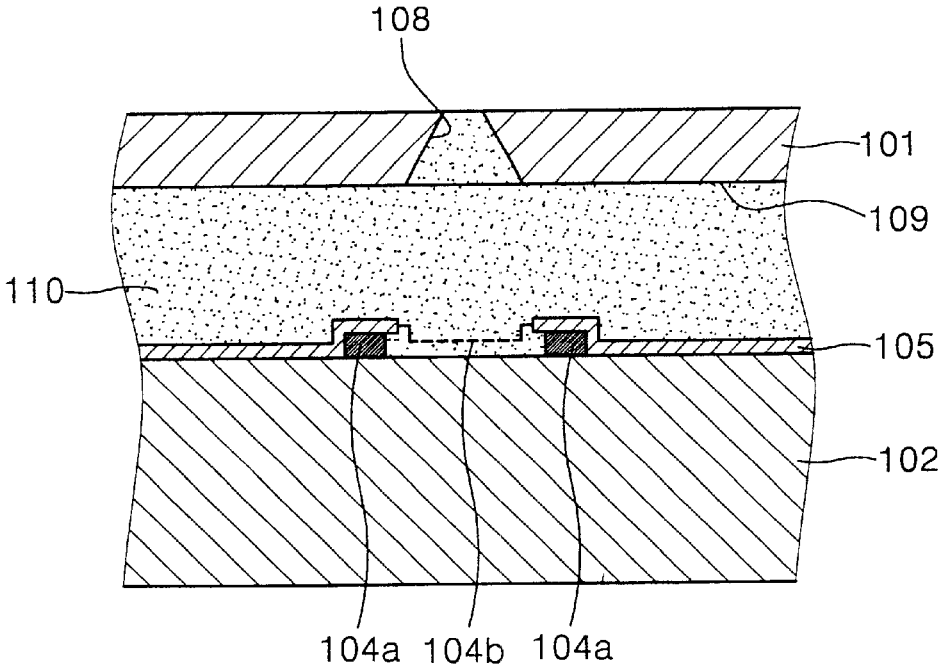
FIGS. 9A–9D are schematic cross-sections showing steps of formation of bubbles and ejection of an ink droplet according to a first embodiment of the present invention.
Figure 9B:
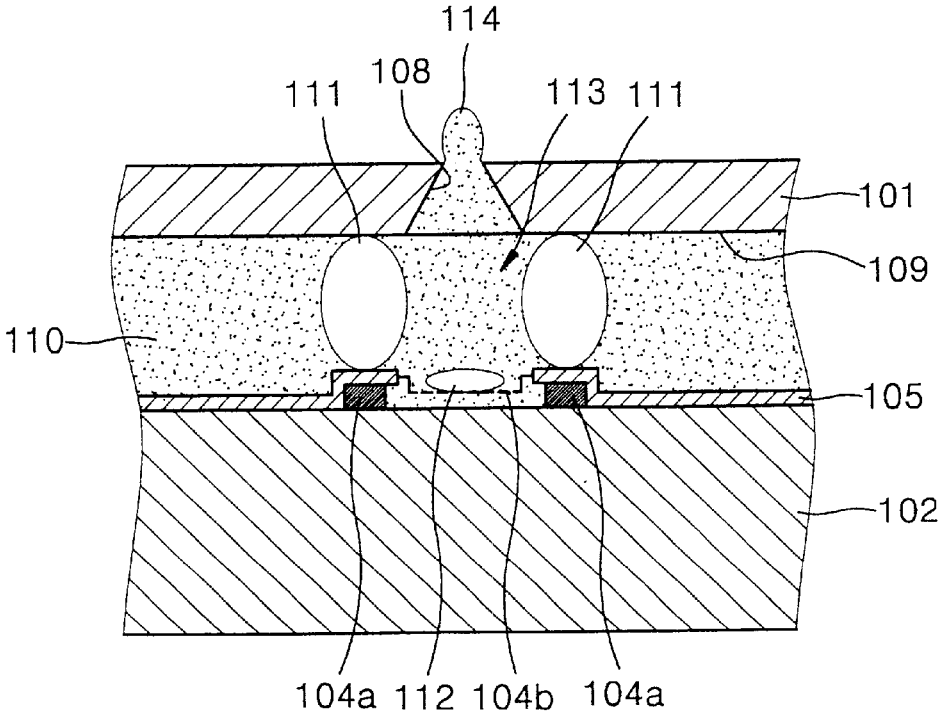
Figure 9C:
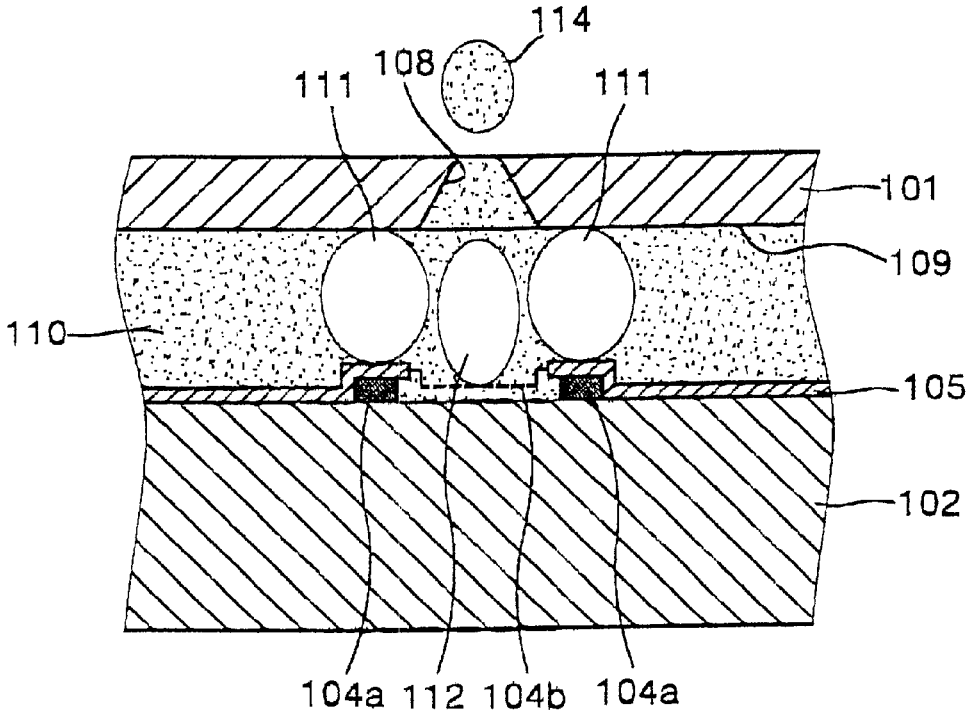

As time progress, the bubbles 111 and 112 become larger, and when the bubble 112 reaches a large volume as shown in FIG. 9C, the ink droplet 114 is ejected from the nozzle 108 by the expansion of the bubbles 111 and 112, the main ejection force being generated by the expansion of the bubble 112.

Figure 9D:
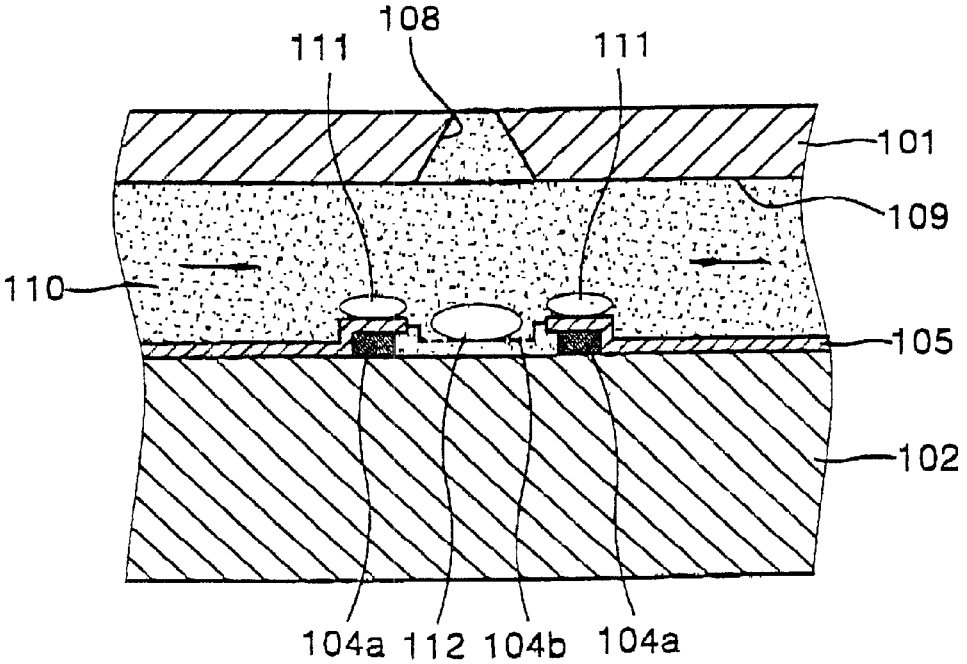

After ejection of the ink droplet 114 through the nozzle 108, the bubbles 111 and 112 shrink as shown in FIG. 9D, and the ink 110 begins to refill, which returns to the state shown in FIG. 9A. The shrinkage of the bubbles 111 and 112 is attributed to the cooling of the first and second resistive layers 104*a* and 104*b* due to the cutoff of the DC pulse. According to the above embodiment, the virtual chamber formed by the bubble 111 spatially separates the ink 110 to be ejected through the nozzle 108. The tail of the ink droplet ejected by the maximum growth of the bubble 112 in the virtual chamber is cut off to prevent the formation of a satellite droplet.

Figure 10:
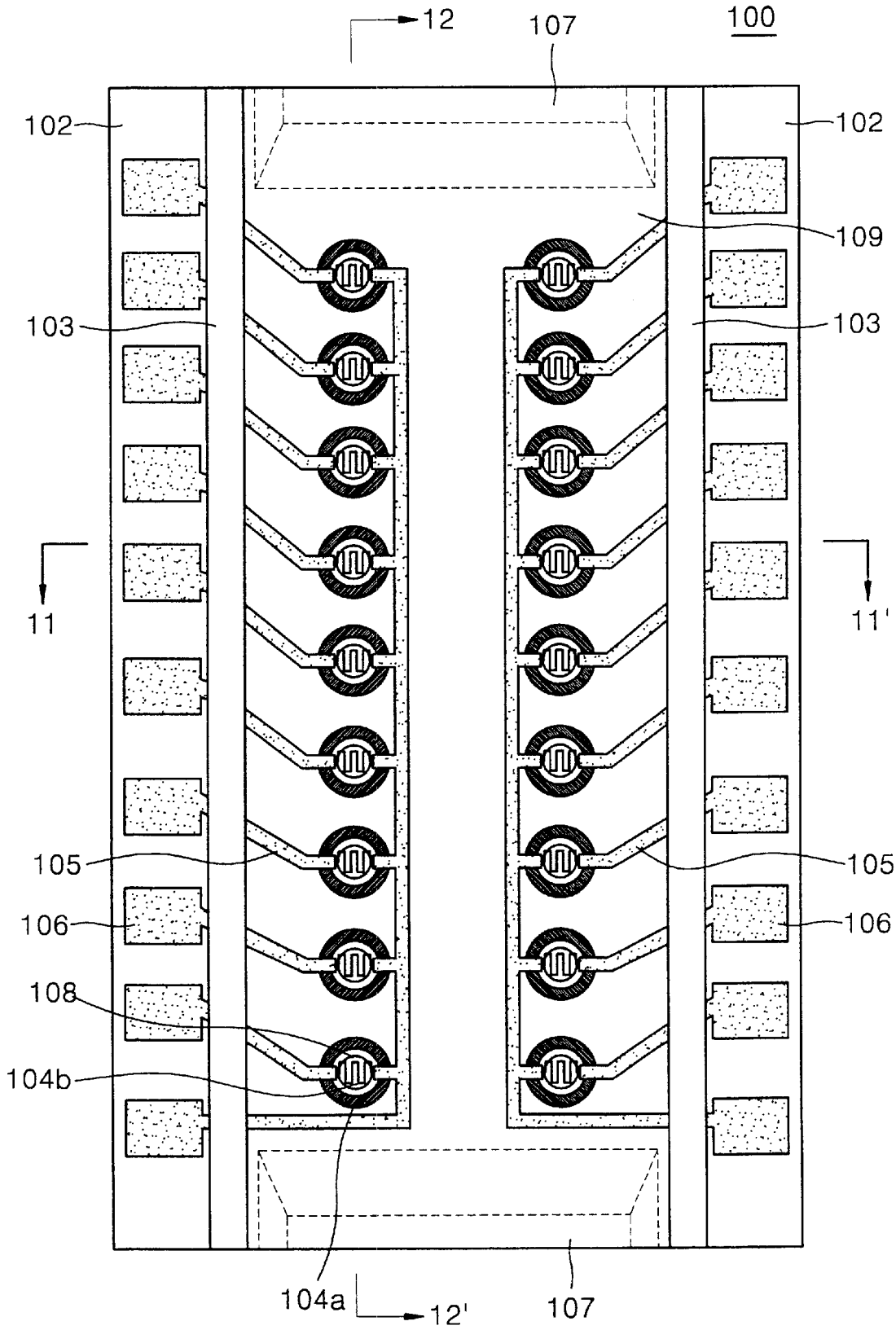
FIG. 10 is a schematic plan view of the bubble-jet type ink-jet printhead according to the first embodiment of the present invention of FIG. 5.
Figure 11:
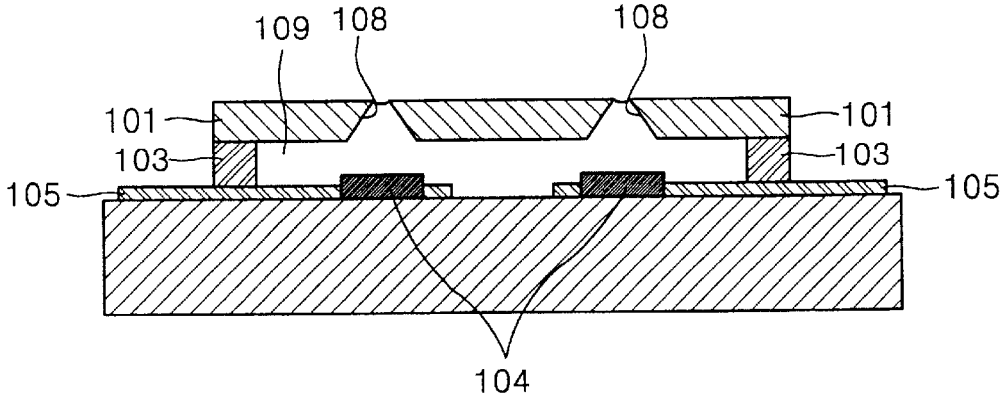
FIG. 11 is a cross-section taken along line 11–11' of FIG. 10.
Figure 12:
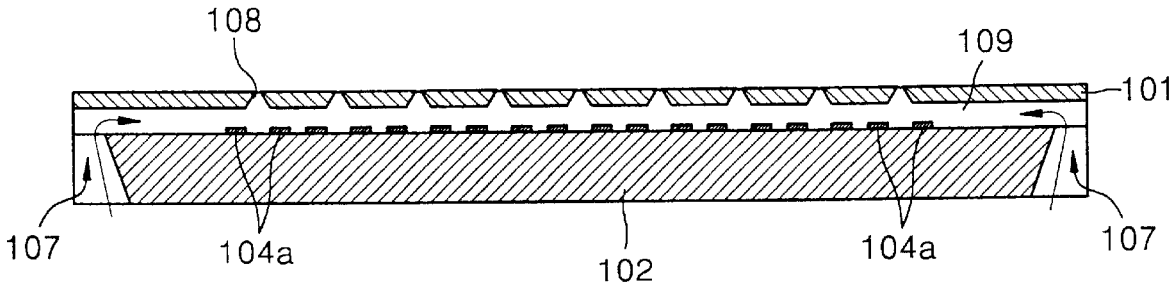
FIG. 12 is a cross-section taken along line 12–12' of FIG. 10.

FIG. 10 is a schematic plan view of the bubble-jet type ink-jet printhead according to the first embodiment of the present invention of FIG. 5. FIGS. 11 and 12 are schematic cross-sections taken along lines 11–11' and 12–12' of FIG. 10, respectively. Referring to FIGS. 10, 11, and 12, ink feed grooves 107 for supplying ink to be filled in the common chamber 109 are provided at either end of the substrate 102. The opposite sides of the common chamber 109 are sealed by the wall 103 as shown in FIG. 11.

Both ends of the common chamber 109 are sealed by a sealing portion (not shown) when the head (100 of FIG. 5) is inserted into the head mount portion (301 of FIG. 5) of the cartridge (300 of FIG. 5) for holding ink. The ink feed groove 107 is connected with the inside of the cartridge 300 for supplying ink. Thus, ink is introduced through the ink feed grooves 107 in the directions indicated by arrows shown in FIG. 12 to fill the common chamber 109.

Figure 13:
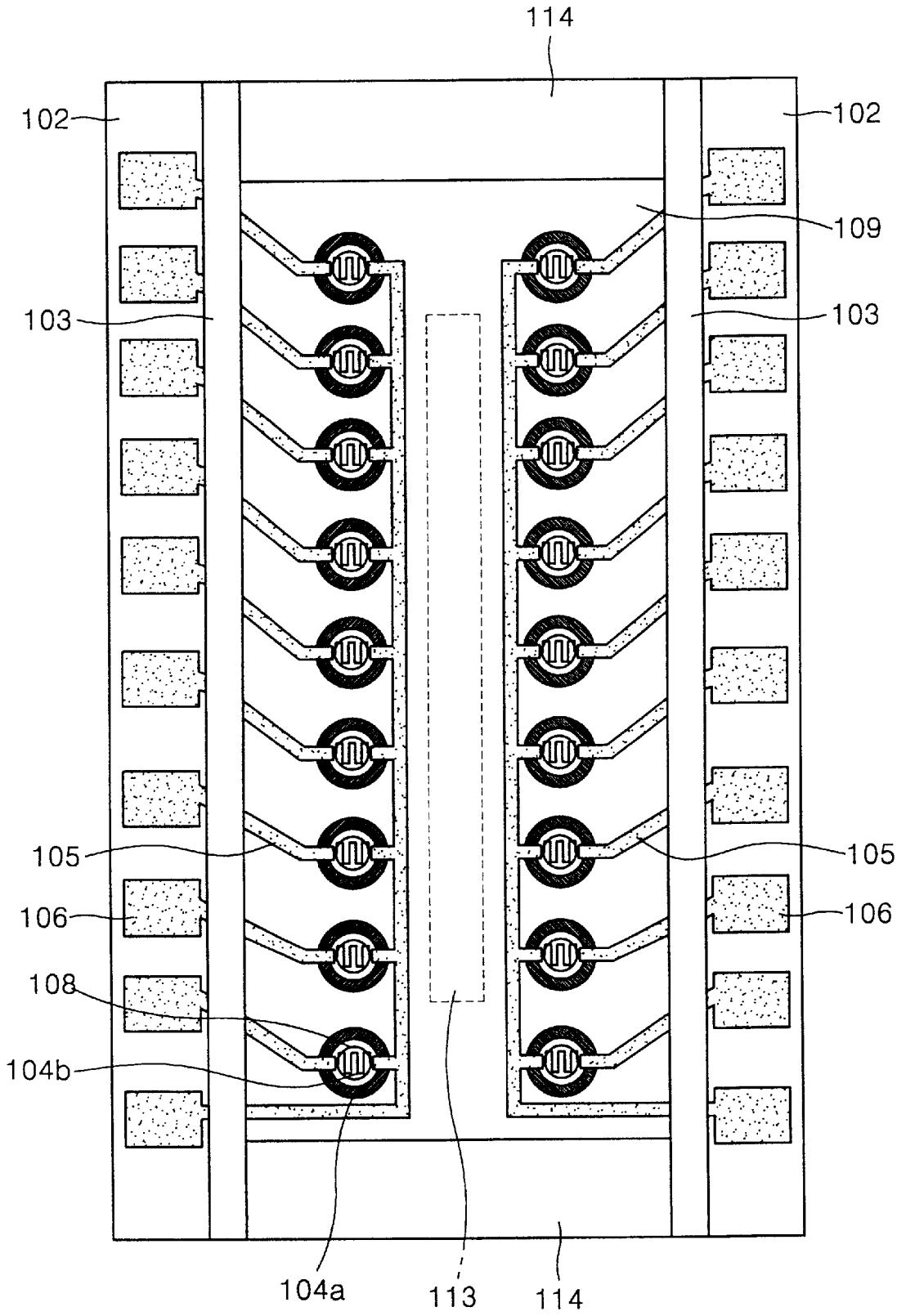
FIG. 13 is a schematic plan view of a bubble-jet type ink-jet printhead according to a second embodiment of the present invention.

FIG. 13 is a schematic plan view of a bubble-jet type ink-jet printhead according to a second embodiment of the present invention. Here, the same reference numeral as shown in FIG. 10 represents the same element having the same function. Referring to FIG. 13, the basic configuration in this embodiment is the same as in the first embodiment. A difference is in the position at which an ink feed groove is formed. That is, an ink feed groove 113 is formed in parallel to the walls 103 in the shape of a long hole at the central portion of the substrate 102. Both ends of the common chamber 109 are sealed by walls 114. In this way, the ink feed groove 113 may be formed at various positions.

Figure 14:
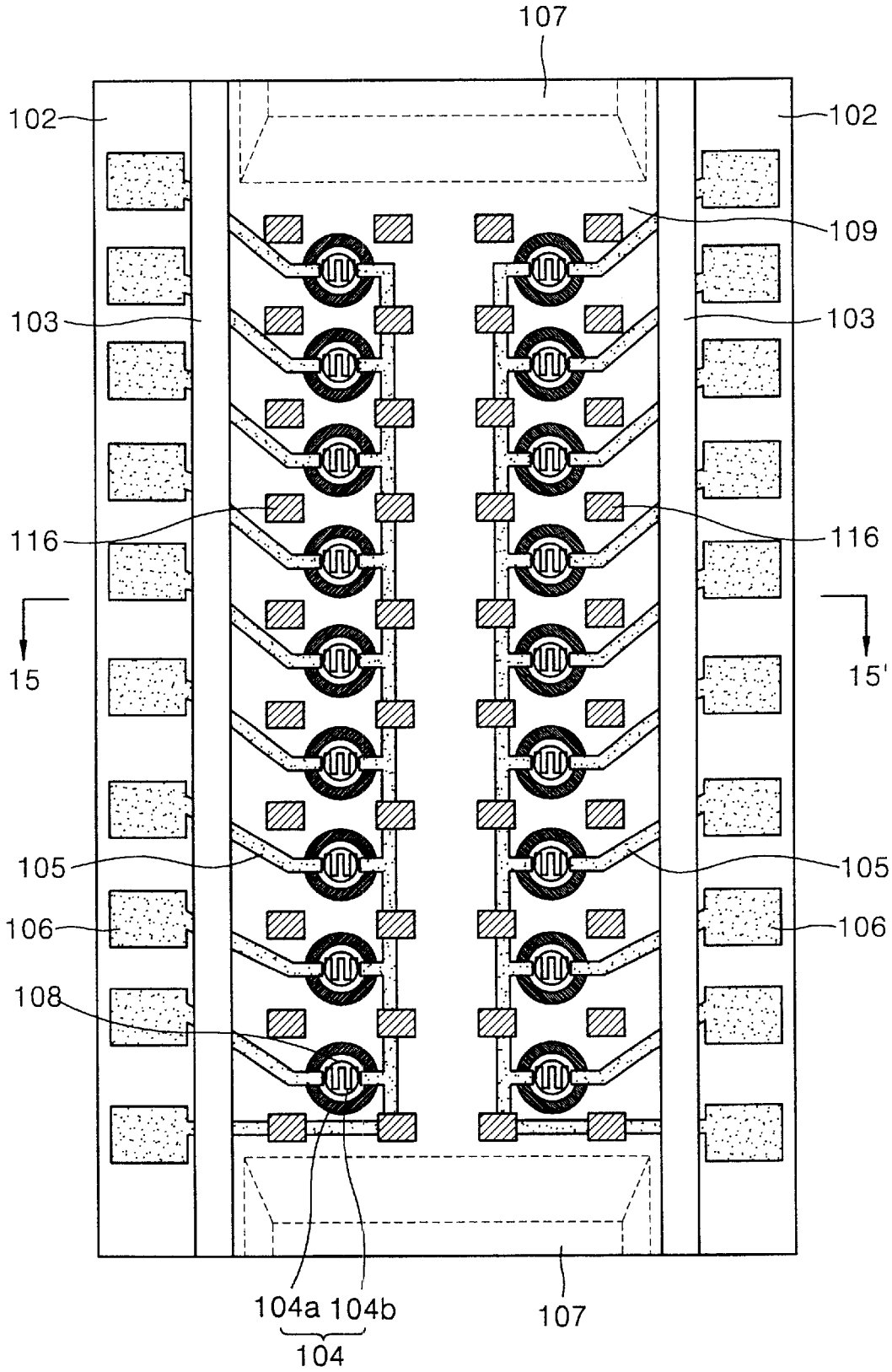
FIG. 14 is a schematic plan view of a bubble-jet type ink-jet printhead according to a third embodiment of the present invention.
Figure 15:
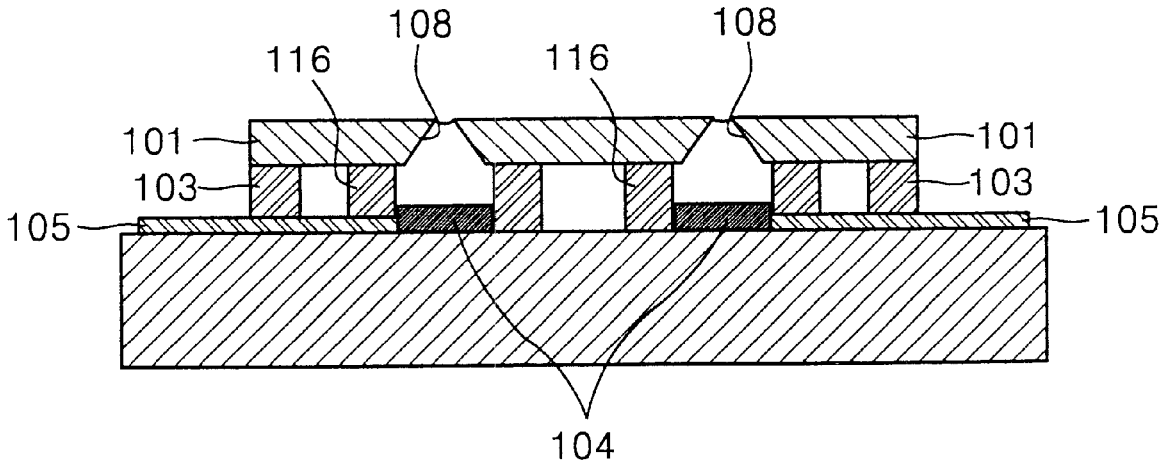
FIG. 15 is a cross-section taken along line 15–15' of FIG. 14.

FIG. 14 is a schematic plan view of a bubble-jet type ink-jet printhead according to a third embodiment of the present invention. FIG. 15 is a schematic cross-section taken along line 15–15' of FIG. 14. Here, the same reference numeral as shown in FIG. 10 represents the same element having the same function. Referring to FIGS. 14 and 15, the basic configuration of an ink-jet printhead in this embodiment is the same as in the first embodiment. A plurality of square-shaped boundary barriers 116 are disposed at regular intervals between the resistive layers 104 on the substrate 102, thereby providing a partitioned region for each resistive layer 104. The height of the boundary barrier 116 is made equal to the gap between the substrate 102 and the nozzle plate 101. The boundary barrier 116 is provided to prevent cross-talk between adjacent nozzles 108 due to pressure generated by bubble formation when bubbles are formed on the resistive layer 104 and to increase ink ejection efficiency at a corresponding nozzle 108 where ink ejection is attempted.

Figure 16:
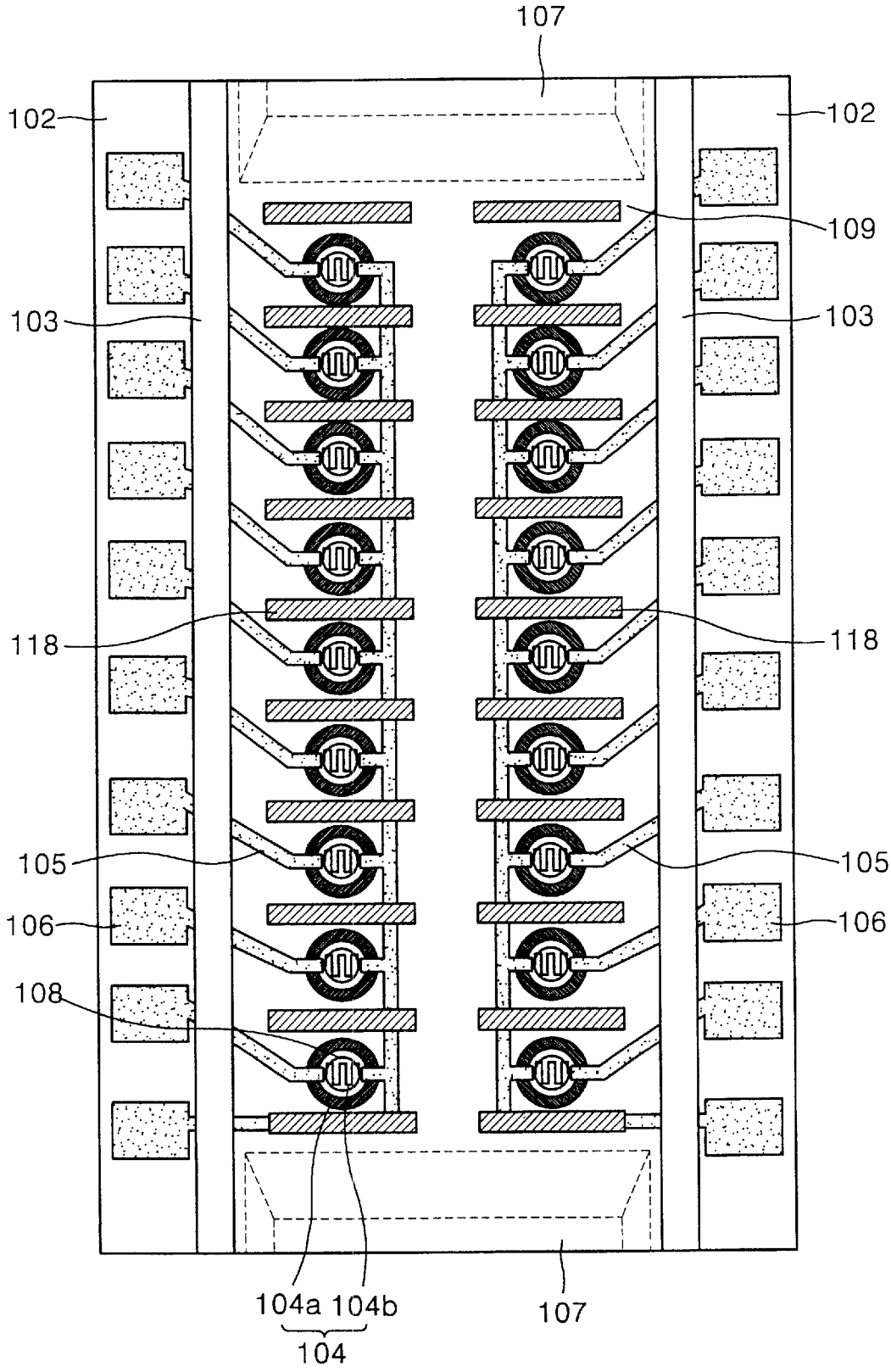
FIG. 16 is schematic plan view of a bubble-jet type ink-jet printhead according to a fourth embodiment of the present invention.

The structure for suppressing cross-talk as described above may be provided within a common chamber in various forms. A modified example for this structure is shown in FIG. 16, which depicts the fourth embodiment of the present invention. Referring to FIG. 16, a plurality of boundary barriers 118 formed in a rectangular shape with a predetermined length is disposed between the resistive layers 104 on the substrate 102. The height of the boundary barrier 118 is equal to the gap between the substrate 102 and the nozzle plate 101.

Figure 17:
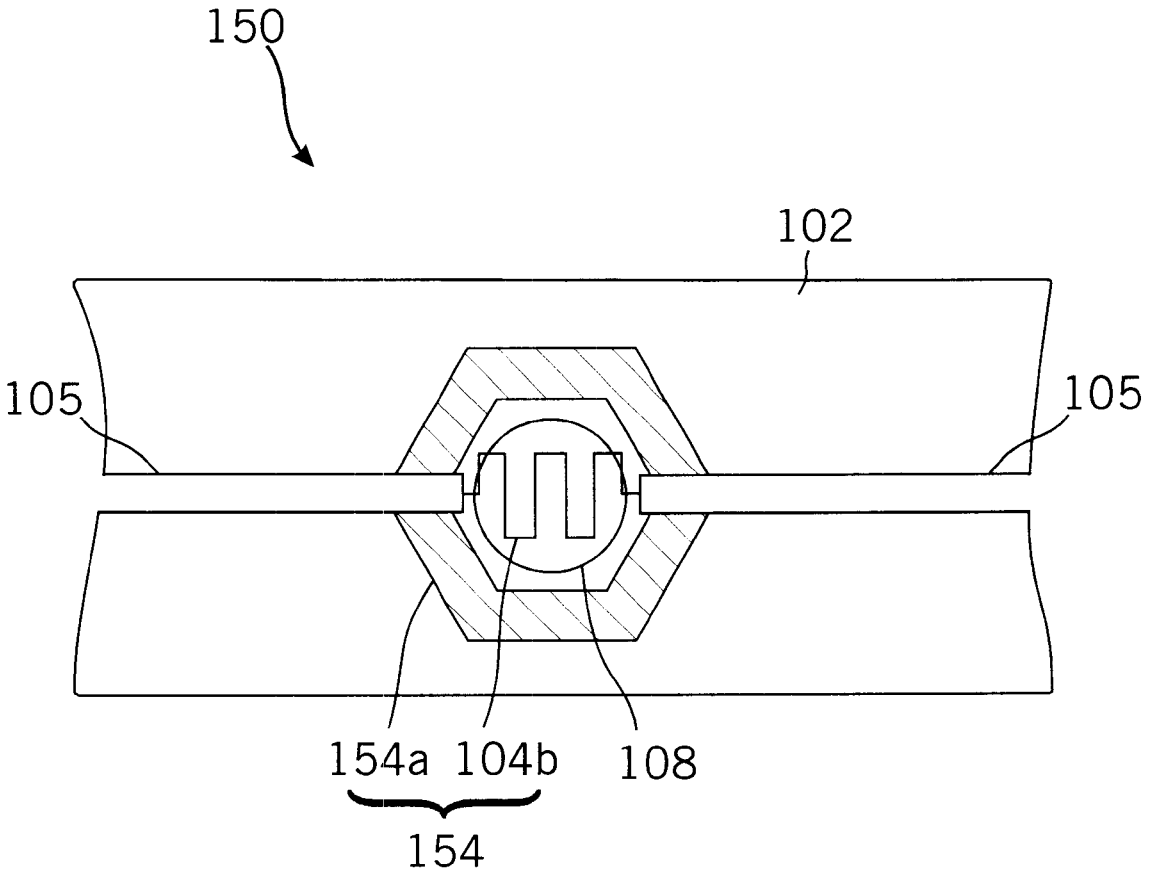
FIG. 17 illustrates an alternative design of the resistive heater elements that can be applied to the first through fourth embodiments of the present invention.

It can be appreciated that the first resistive layer can take on other shapes than just circular. FIG. 17 illustrates a structure of a bubble-jet type ink-jet printhead 150 having a hexagonal first resistive layer 154*a*. The hexagonal first resistive layer can be employed in all four embodiments of the present invention. In addition, the first resistive layer may be any closed polygon and may be applied to all four embodiments of the present invention.

As described above, a bubble-jet type ink-jet printhead according to the present invention is constructed such that a big bubble is formed on each resistive layer with a predetermined time interval by connecting a plurality of resistors in parallel. Thus, this increases the ejection efficiency of ink droplet without an additional means. Furthermore, a boundary barrier is provided to prevent a back flow of ink thereby avoiding cross-talk between adjacent nozzles. In particular, ink refills the virtual chamber for each nozzle from every direction, thereby allowing for continuous high-speed ink ejection.

While this invention has been particularly shown and described with references to preferred embodiments thereof, it will be understood by those skilled in the art that various changes in form and details may be made therein without departing from the spirit and scope of the invention as defined by the appended claims.

What is claimed is:

1. A bubble-jet type ink jet printhead, comprising:

a substrate;

a nozzle plate having a plurality of nozzles, the nozzle plate being separated a predetermined distance from the substrate;

a plurality of walls for closing the space between the substrate and the nozzle plate and then forming a common chamber between the substrate and the nozzle plate;

a plurality of first resistive layers formed on the substrate within the common chamber corresponding to the plurality of nozzles, each of the plurality of first resistive layers being centered around a central axis passing through a center of each of said plurality of nozzles;

a plurality of second resistive layers, each one of said plurality of second resistive layers being surrounded by corresponding ones of said plurality of first resistive layers, wherein each second resistive layer is electrically connected in parallel to each first resistive layer allowing a formation of a bubble on said central axis passing through said center of each of said plurality of nozzles by each one of said plurality of second resistive layers;

a plurality of pairs of electrically conductive layers formed on the substrate, each pair being connected to the first and second resistive layers and extending to an outside of said common chamber; and a plurality of electrode pads which are disposed at said outside of said common chamber on said substrate and electrically connected to said electrically conductive layers.

2. The printhead of claim 1, wherein the second resistive layer has resistance greater than the first resistive layer.

3. The printhead of claim 2, wherein the second resistive layer is longer and narrower than the first resistive layer.

4. The printhead of claim 1, wherein ink feed grooves are formed at two opposite ends of said common chamber on the substrate for supplying ink to said common chamber.

5. The printhead of claim 4, wherein a boundary barrier for dividing the common chamber into a plurality of regions and allowing ink to flow from one region to another by spatially connecting the plurality of regions is disposed within the common chamber, wherein the boundary barrier has a height equal to the gap between the substrate and the nozzle plate.

6. The printhead of claim 1, wherein an ink feed groove is formed at a center of said common chamber supplying ink to said common chamber.

7. The printhead of claim 6, wherein a boundary barrier for dividing the common chamber into a plurality of regions and allowing ink to flow from one region to another by spatially connecting the plurality of regions is disposed within the common chamber, wherein the boundary barrier has a height equal to the gap between the substrate and the nozzle plate.

8. The printhead of claim 1, wherein a boundary barrier for dividing the common chamber into a plurality of regions and allowing ink to flow from one region to another by spatially connecting the plurality of regions is disposed within the common chamber, wherein the boundary barrier has a height equal to the gap between the substrate and the nozzle plate.

9. A bubble-jet type ink jet printhead, comprising:

a substrate;

a nozzle plate having a plurality of nozzle holes, each having a perimeter, the nozzle plate being separated a predetermined distance from the substrate by a plurality of walls disposed on a perimeter of a common ink chamber;

a pair of first resistors disposed on said substrate underneath each perimeter of each of said plurality of nozzle holes from a first point underneath said perimeter of said nozzle hole to a second point underneath said perimeter of said nozzle hole diametrically opposite to said first point, said pair of first resistors forming a closed polygon;

a second resistor disposed on said substrate between said first point and said second point and disposed within said closed polygon underneath said nozzle hole, said second resistor having a resistance greater than either one of said pair of first resistors;

a common electrode line extending to each second point underneath each perimeter of each nozzle hole; and a plurality of electrical signal lines extending to respective ones of said plurality of first points underneath respective ones of said perimeters of each of said plurality of nozzle holes.

10. The printhead of claim 9, wherein each one of said plurality of signal lines and said common line terminates at a metal pad disposed on said substrate outside said plurality of walls.

11. The printhead of claim 9, further comprising ink feed grooves at opposite ends of said printhead along portions of said perimeter of said common chamber absent said walls.

12. The printhead of claim 9, wherein said walls completely surround said common chamber and an ink feed groove being disposed in said substrate at center of said common chamber.

13. The printhead of claim 9, wherein portions of said substrate disposed beneath ones of said plurality of said nozzle holes are separated by a boundary barrier.

14. A bubble-jet type ink-jet printhead, comprising:

a substrate;

a nozzle plate separated at a predetermined distance from said substrate, said nozzle plate being perforated by a first plurality of nozzle holes, each nozzle hole having a central axis extending vertically from said substrate through a center of each nozzle hole, each nozzle hole having a perimeter;

a plurality of walls disposed on a perimeter of a common chamber on said printhead, said plurality of walls attaching said nozzle plate to said substrate, said plurality of walls, said nozzle plate, and said substrate defining said common ink chamber within;

a plurality of first resistors disposed on said substrate, said plurality of first resistors being located beneath each perimeter of each one of said first plurality of nozzle holes, pair of first resistors forming a closed pattern, said pair of first resistors being disposed under each one of said first plurality of nozzle holes;

a plurality of second resistors being located underneath corresponding respective ones of said first plurality of nozzle holes, each one of said plurality of second resistors being surrounded by corresponding pairs of said plurality of first resistors, each one of said plurality of second resistors forming electrical contact at diametrically opposite portions of said closed pattern of corresponding pairs of said plurality of first resistors;

a common electrical lead electrically connected to one of two points where said pair of first resistors electrically contact said second resistor; and a first plurality of signal electrical leads extending to another of said two points where said pair of first resistors make electrical contact with said second resistor.

15. The printhead of claim 14, wherein a resistance of each one of said plurality of second resistors exceeds the resistance of each one of said plurality of first resistors.

16. The printhead of claim 14, wherein each of said plurality of first resistors and said plurality of second resistors is a layer of electrically resistive material having a predetermined height, width, and length.

17. The printhead of claim 14, wherein said plurality of walls equals two and a remaining portion of said perimeter being absent walls and comprising ink feed grooves supplying ink to said common chamber.

18. The printhead of claim 14, wherein said plurality of walls is four, said four walls being disposed so as to cover a complete perimeter of said common chamber, an ink feed groove being disposed in a center of said common chamber by a hole in said substrate supplying ink to said chamber.

19. The printhead of claim 14, wherein said common electrical lead terminates at an electrically conducting pad exterior to said common chamber and said first plurality of signal leads terminating at a first plurality of electrically conducting pads exterior to said common chamber.

20. The printhead of claim 14, further comprising a plurality of boundary barriers within said common chamber and exterior to each of said plurality of first resistors, each one of said plurality of boundary layers forming contact with both said nozzle plate and said substrate.

* * * * *